US007051768B2

(12) United States Patent
Takahashi

(10) Patent No.: US 7,051,768 B2
(45) Date of Patent: May 30, 2006

(54) HYDROFORM PROCESS AND HYDROFORM PRODUCT

(75) Inventor: Junichi Takahashi, Tokyo (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/337,994

(22) Filed: Jan. 8, 2003

(65) Prior Publication Data

US 2003/0102045 A1 Jun. 5, 2003

Related U.S. Application Data

(63) Continuation of application No. PCT/JP02/04741, filed on May 16, 2002.

(30) Foreign Application Priority Data

May 22, 2001 (JP) ..... 2001-152775

(51) Int. Cl.
*F16L 9/14* (2006.01)

(52) U.S. Cl. ..... 138/143; 138/114; 72/367.1; 72/61

(58) Field of Classification Search ..... 138/143, 138/114; 72/367.1, 61
See application file for complete search history.

(56) References Cited

U.S. PATENT DOCUMENTS 4,823,847 A * 4/1989 Grosse et al. ..... 138/143
5,170,557 A * 12/1992 Rigsby ..... 29/890.08
5,363,544 A * 11/1994 Wells et al. ..... 29/523
5,475,911 A * 12/1995 Wells et al. ..... 29/33 T
5,495,873 A * 3/1996 Butkiewicz et al. ..... 138/114
5,582,052 A * 12/1996 Rigsby ..... 72/62
5,836,065 A * 11/1998 Dehlinger et al. ..... 29/33 T
6,209,319 B1 * 4/2001 Maeda et al. ..... 60/323
6,254,488 B1 * 7/2001 Hill ..... 464/180
6,484,384 B1 * 11/2002 Gibson et al. ..... 29/516
6,497,030 B1 * 12/2002 Marando ..... 29/421.1
6,659,137 B1 * 12/2003 Imasaki et al. ..... 138/142
6,729,354 B1 * 5/2004 Ishizu et al. ..... 138/109
6,742,576 B1 * 6/2004 Bergevin ..... 165/133

FOREIGN PATENT DOCUMENTS

JP 2-080130 3/1990
JP 10-258328 A 9/1998
JP 2001-62522 A 3/2001
JP 2001-219226 A 8/2001
JP 2001-334316 A 12/2001

OTHER PUBLICATIONS

Aproximate Comparison of Hardness Scale, www.calce.umd.edu/general/facilities/images/image013.gif, Mar. 2005.*

Ogletree's Carbon Steel, Stainless Steel, and Aluminum Fabrication, www.ogletrees.com/materials.html, copyright 2003.*

* cited by examiner

*Primary Examiner*—James Hook
(74) *Attorney, Agent, or Firm*—Birch Stewart Kolasch & Birch

(57) ABSTRACT

When hydroforming a steel pipe, a tubular deformation assisting member made of an incompressible material softer than the steel pipe is fitted on the outer peripheral surface of the steel pipe. The deformation assisting member is attached at least to an area corresponding to a projection provided at the inner surface of the die assembly, the projection being earliest brought into contact with the outer peripheral surface of the steel pipe during hydroforming. When hydroforming the steel pipe, the material of the deformation assisting member plastically flows near corner portions at which the deformation assisting member is brought into contact with the projection.

11 Claims, 6 Drawing Sheets

PRIOR ART

HYDROFORM PROCESS AND HYDROFORM PRODUCT

CROSS-REFERENCE TO RELATED APPLICATIONS

This is a Continuation Application of PCT Application No. PCT/JP02/04741, filed May 16, 2002, which was not published under PCT Article 21(2) in English.

This application is based upon and claims the benefit of priority from the prior Japanese Patent Application No. 2001-152775, filed May 22, 2001, the entire contents of which are incorporated herein by reference.

BACKGROUND OF THE INVENTION

1. Field of the Invention

The present invention relates to a hydroform process for forming an original tube member, using a die having portions to be brought into contact with the outer peripheral surface of the original tube member, and also relates to a hydroform product obtained by the hydroform process.

2. Description of the Related Art

In the field of reinforcing members for reinforcing each section of vehicles such as automobiles, the employment of reinforcing members formed by hydroforming an original tube member is now being advanced.

Referring to FIGS. 5A to 6C, an example of a conventional hydroform process will be described. A die assembly 5 shown in FIG. 5A comprises an upper die 2 having a lower surface serving as a molding surface 1, and a lower mold 4 having an upper surface serving as a molding surface 3. An original tube member, such as a steel pipe 6, is placed in the die assembly 5.

After that, as shown in FIG. 5B, a pressurized liquid (e.g. water) is supplied into the steel pipe 6, thereby expanding the pipe 6 by internal pressure. Thus, the steel pipe 6 is expanded in a width direction. The expanded pipe 6 is pressed against the molding surfaces 1 and 3 of the die assembly 5. As a result, the reinforcing member 7 having the closed cross section as shown in FIG. 5C is formed.

The reinforcing member 7, which has a closed section obtained by hydroforming the steel pipe 6, has a peripheral continuous wall. This peripheral wall is hardened by the work hardening effect resulting from circumferential extension of the wall. As a result, the reinforcing member 7 is characterized in that it has a thin wall thickness and a high rigidity.

The shape of the reinforcing member 7 may be complicated by comprising indents and/or protrusions in the section, as shown in FIG. 5C, as required.

To form a reinforcing member 7 with a complicated cross section, it is necessary to use an upper die 2 and lower die 4 having respective complicated molding surfaces corresponding to the cross section of the reinforcing member 7.

However, dies of certain sectional shapes may interrupt the expansion of the steel pipe 6, since only parts of the dies are brought into contact with the outer peripheral surface of the steel pipe 6 during a hydroform process.

For example, the die assembly 5 shown in FIG. 5A and 5B has a molding surface 3 in the form of a trapezoidal recess. The other molding surface 1 has an indent 1*a*, projection 1*b*, stepped portion 1*c*, etc.

During hydroforming, therefore, some parts of the steel pipe 6 are brought into contact with the molding surfaces 1 and 3 before other parts, as shown in FIG. 6A. For example, a first corner portion X1 near the tip of the projection 1*b* of the inner surface of the die assembly 5, an inner surface X2 opposing the corner portion X1, a second corner portion Y1 adjacent to the corner portion X1, and an inner surface Y2 opposing the corner portion Y1 are brought into contact with the outer periphery of the steel pipe 6 before other portions. In this example, the projection 1*b* corresponds to "predetermined portion of a die" stated in the present invention.

After that, tube expansion is advanced as shown in FIG. 6B. During the expansion process, in the molding area L1 between the corner portion X1 and inner surface X2 of the projection 1*b*, the steel pipe 6 is expanded, kept in contact with the corner portion X1 and inner surface X2 and held by these portions. Also in the stepped molding area L2 between the corner portion Y1 and inner surface Y2, the steel pipe 6 is expanded, kept in contact with the corner portion Y1 and inner surface Y2 and held by these portions.

In this conventional case, suppose that hydroforming is started by applying hydraulic pressure to the steel pipe 6, set in the die assembly 5, from inside. While the steel pipe 6 is being expanded by the hydraulic pressure, it is brought into contact with the corner portions X1 and Y1 of the projection 1*b*, the inner surface X2 at one side, and the inner surface Y2 at the other side. As a result, the outer periphery of the steel pipe 6 is held in the die assembly 5 by friction at the corner portions X1 and Y1 and inner surfaces X2 and Y2, as is shown FIG. 6A.

Since the steel pipe 6 is held at the corners X1 and Y1 of the die assembly 5, it is prevented from uniform extension in the circumference, and hence from uniformly expanding, as is shown in FIGS. 6B and 6C.

Specifically, the to-be-expanded steel pipe 6 is held by friction at the corner portions X1 and Y1 and inner surfaces X2 and Y2 in the molding areas L1 and L2. Accordingly, the entire steel pipe 6 is not uniformly expanded. The extension of the peripheral wall of the steel pipe 6 is advanced between the corner portion X1 and inner surface X2, and the corner portion Y1 and inner surface Y2. In other words, the degree of extension of portions in the molding areas L1 and L2 is greater than that of the other portions.

If the degree of extension of some portions of the steel pipe 6 is greater than that of the other portions during the hydroform process, the wall thickness of the resultant steel pipe 6 is circumferentially non-uniform, as shown in FIG. 6C. In this case, the wall thickness t2 of the resultant steel pipe 6 in the molding areas L1 and L2 is thin, whereas the wall thickness t1 of the portions corresponding to the corner portions X1 and Y1 and inner surfaces X2 and Y2 is thick.

Thus, in a hydroform product having a complicated cross section, the wall thickness is liable to be circumferentially non-uniform, which makes it difficult to obtain a predetermined rigidity. Moreover, if a portion of the steel pipe 6 is extremely extended, it becomes extremely thin and hence may be damaged.

To avoid this problem, it has been proposed that lubricating oil be applied between the die assembly 5 and steel pipe 6, thereby making their contact portions slippery. However, this countermeasure is not sufficient, and a further improvement is demanded.

BRIEF SUMMARY OF THE INVENTION

It is an object of the invention to provide a hydroform process capable of enlarging an original tube member to have a sufficiently uniform wall thickness, and a hydroform product obtained by the hydroform process.

In the invention, when hydroforming an original tube member, an assisting member made of an incompressible material softer than the original tube member is fitted to the original tube member. The assisting member exists at least the portion of the outer peripheral surface of the original tube member that is earliest brought into contact with the predetermined portion of the die assembly. The predetermined portion is, for example, a projection facing the outer peripheral surface of the original tube member.

When hydroforming an original tube member, the predetermined portion of the inner surface of the die assembly is earliest brought into contact with the outer peripheral of the original tube member. At the point where the predetermined portion contacts the assisting member, a compression load is exerted on the assisting member. The assisting member is made of an incompressible material that is softer than the original tube member, which shows only a small change in volume for the compression load. Accordingly, when the predetermined portion is brought into contact with the assisting member and receives a compression load during the hydroforming, part of the material of the assisting member experiences plastic flow in the direction away from the portion in contact with the die assembly.

When the assisting member plastically flows, the original tube member, which is contained in the assisting member in tight contact therewith, is extended in the same direction as the plastic flow by friction therebetween. Thus, even the portions that are not extended in the conventional case can be extended in the same direction as the flow of the material of the assisting member.

The assisting member covers the original tube member both at the areas corresponding to the predetermined portions of the dies, and areas continuous therewith. Accordingly, as a result of the plastic flow of the assisting member, expansion of the original tube member proceeds uniformly in the molding areas as well as in other areas. As a result, local reduction of the wall thickness of the original tube member is suppressed.

Therefore, even if parts of the assisting member are brought into contact with the die during hydroforming, the original tube member inside the assisting member can be expanded so that its wall thickness will be kept substantially uniform in the circumferential direction. According to the present invention, even if a cross section of a hydroform product is complicated, the original tube member can be expanded so that wall thickness of the original tube member is substantially uniform in the circumferential direction.

In the invention, it is preferable that the assisting member is a tubular member fitted on the outer peripheral surface of the original tube member. When this assisting member is used, the outer peripheral surface of the original tube member is in tight contact with the inner surface of the assisting member as the original tube member is expanded. Therefore, in accordance with the plastic flow of the material of the assisting member near the predetermined portion, corresponding portions of the original tube member are smoothly extended, which enables smooth expansion of the entire original tube member.

In hydroform products made using this invention, an assisting member made of an incompressible material softer than the original tube member is attached at least to the area included in the outer peripheral surface of the original tube member and corresponding to the projection of the inner surface of the die.

The present invention utilizes the above-described feature of the hydroform process, thereby providing a hydroform product of a high rigidity in which circumferential non-uniformity of the wall thickness of the original tube member is suppressed.

The original tube member is, for example, a steel pipe. The assisting member is made of, for example, a low carbon steel, soft iron, copper or aluminum. In the specification, "aluminum" indicates an aluminum alloy, as well as substantially 100% aluminum.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Referring to FIGS. 1A to 4, an embodiment of the invention will be described.

Figure 2A:
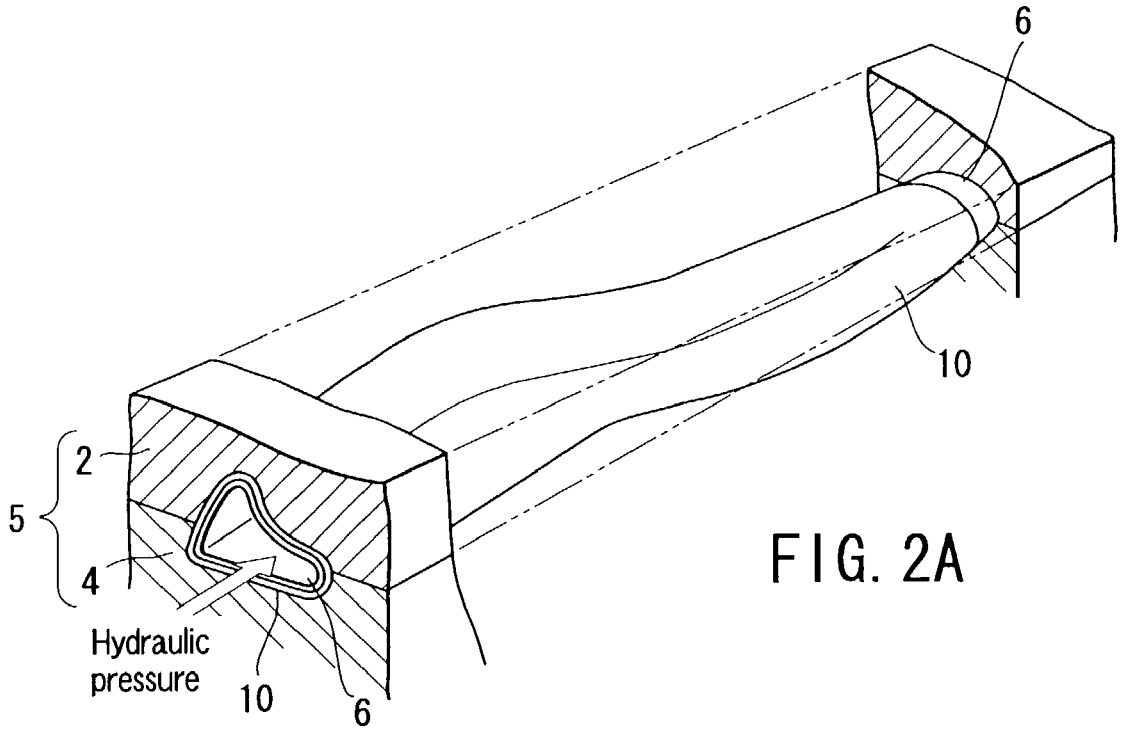
FIG. 2A is a perspective view illustrating parts of the die assembly shown in FIG. 1B, and a hydroform product.
Figure 2B:
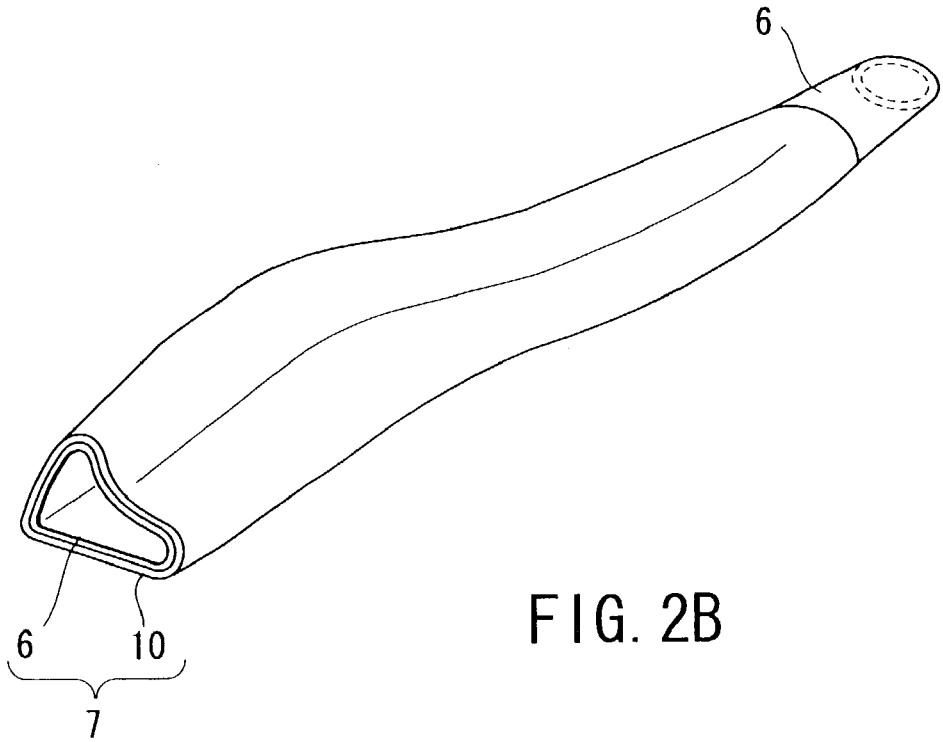
FIG. 2B is a perspective view illustrating the hydroform product shown in FIG. 2A.

In the embodiment, a description will be given of the case where a reinforcing member 7 as an example of a hydroform product is obtained by a hydroform process. As shown in FIG. 2B, the reinforcing member 7 has a complicated cross section that has a projection and indent at predetermined circumferential portions.

The reinforcing member 7 is a composite member formed of a steel pipe 6 corresponding to the original tube member specified in the present invention, and a deformation assisting member 10 corresponding to the assistant member specified in the present invention.

When hydroforming the reinforcing member 7, the deformation assisting member 10 is attached to the steel pipe 6 beforehand, in order to assist deformation of the steel pipe 6. Hydroforming of the steel pipe 6 is executed using the deformation assisting member 10. In this embodiment, a substantially uniform wall thickness along the circumferential direction is possible when the steel pipe 6 is expanded in a radius direction as is mentioned later.

Specifically, when hydroforming the steel pipe 6, the deformation assisting member 10 for assisting deformation of the steel pipe 6 is attached to at least the following areas that are included in the outer peripheral surface of the steel pipe 6.

Figure 3A:
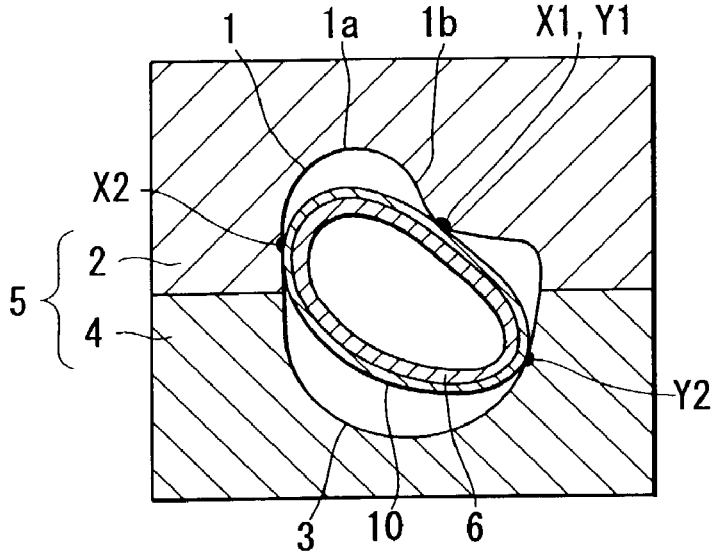
FIG. 3A is a sectional view illustrating an assistant member and steel pipe at the initial stage of hydroforming executed using the die assembly shown in FIG. 2A.

The areas on which the deformation assisting member 10 is provided are areas including the portions of the outer peripheral surface of the steel pipe 6 that are brought into contact with the molding surfaces 1 and 3 earliest during the hydroforming. If, for example, a die assembly 5 shown in FIG. 3A is used, the areas on which the deformation assisting member 10 is provided include the areas of the outer peripheral surface of the steel pipe 6 which correspond to the corner portions X1 and Y1 of the projection 1*b*, and correspond to the inner surfaces X2 and Y2 opposing the corner portions X1 and Y1, respectively.

Further, the areas on which the deformation assisting member 10 is provided also include the areas of the outer peripheral surface of the steel pipe 6 which correspond to the molding area L1 between X1 and X2 and the molding area L2 between Y1 and Y2. It is understood that, during hydroforming, the corner portions X1 and Y1 and inner surfaces X2 and Y2 are brought into contact with the deformation assisting member 10 earlier than the other portions, whereby local deformation occurs at the molding areas L1 and L2.

Figure 3B:
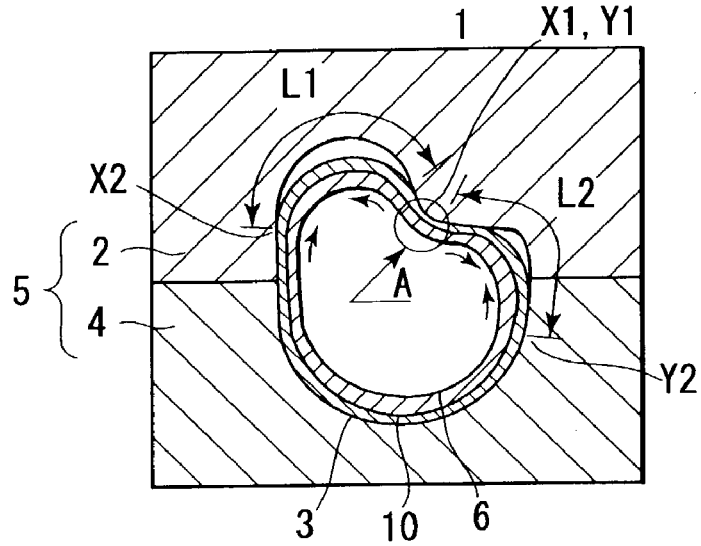
FIG. 3B is a sectional view illustrating the steel pipe and assistant member at a later forming stage.
Figure 3C:
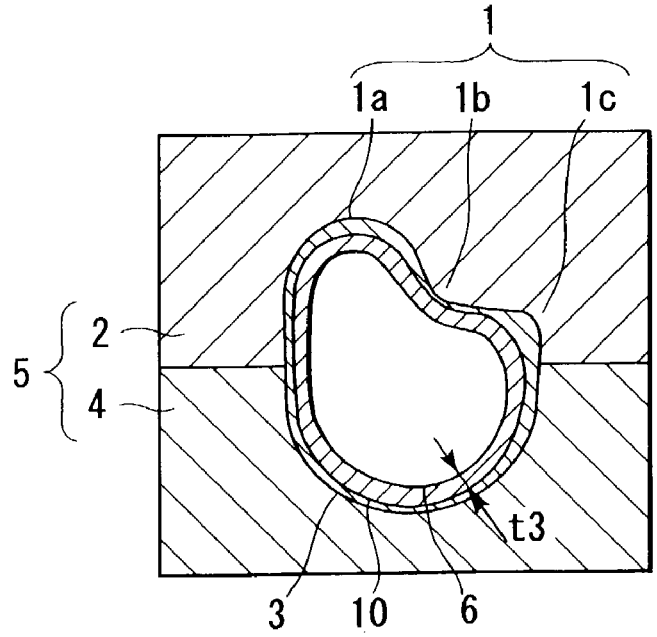
FIG. 3C is a sectional view illustrating the steel pipe and assistant member obtained when hydroforming is finished.
Figure 4:
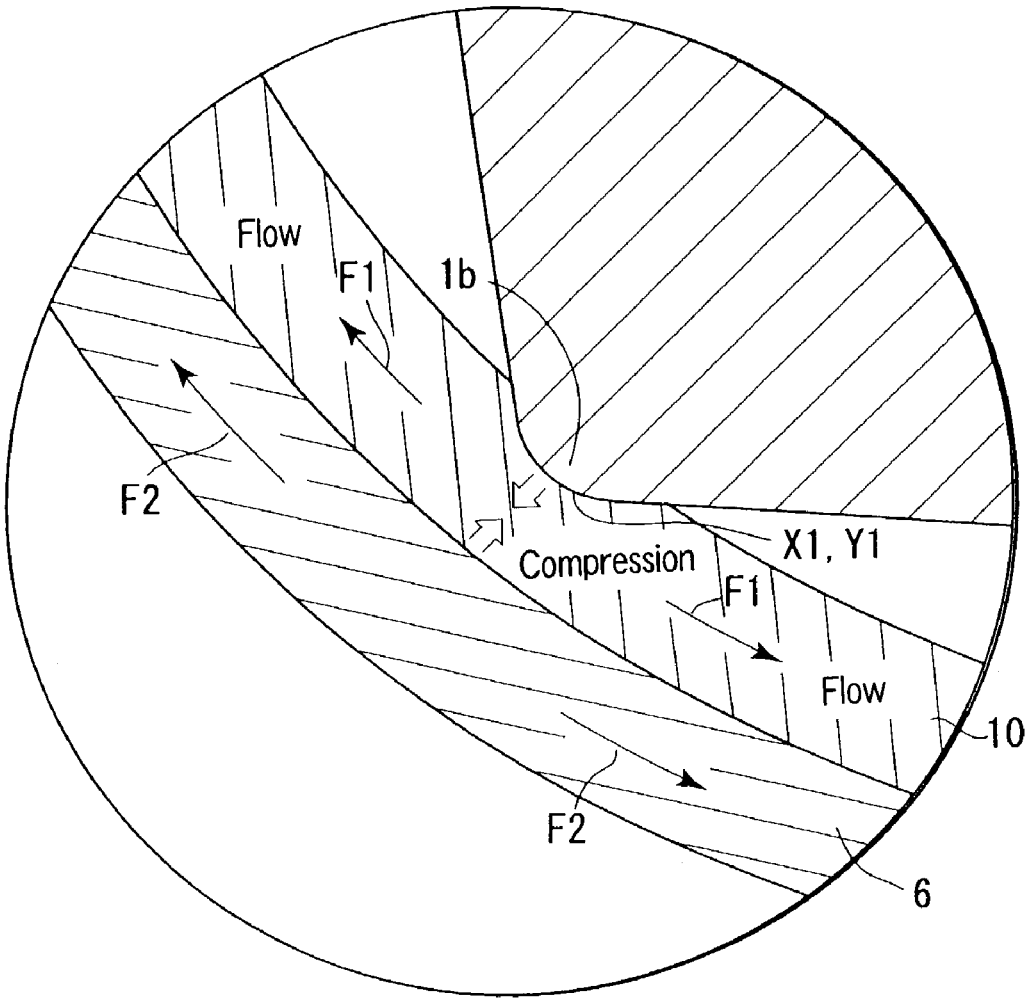
FIG. 4 is an enlarged sectional view illustrating a portion A in FIG. 3B.
Figure 5A:
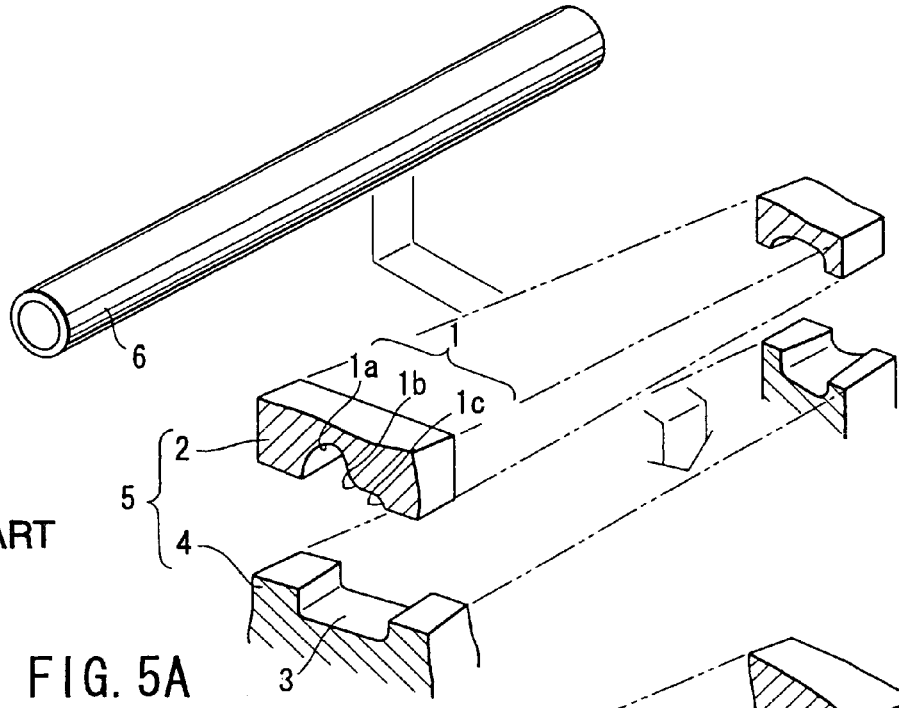
PRIOR ART FIG. 5A
FIG. 5A is a perspective view illustrating portions of a steel pipe and die assembly used in a conventional hydroform process.
Figure 5B:
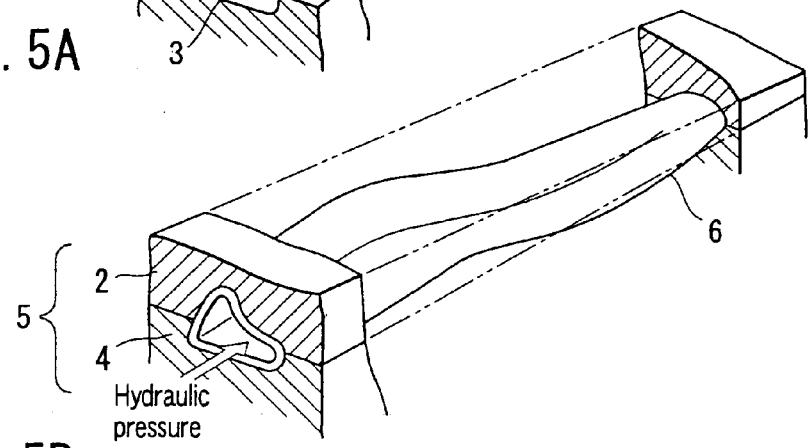
FIG. 5B PRIOR ART
FIG. 5B is a perspective view illustrating a state in which the steel pipe is set in the die assembly in FIG. 5A.
Figure 5C:
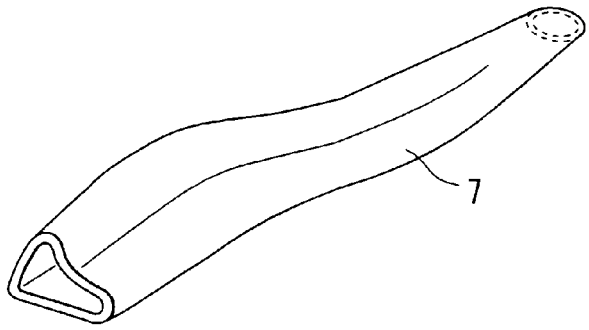
FIG. 5C is a perspective view illustrating a conventional hydroform product.
Figure 6A:
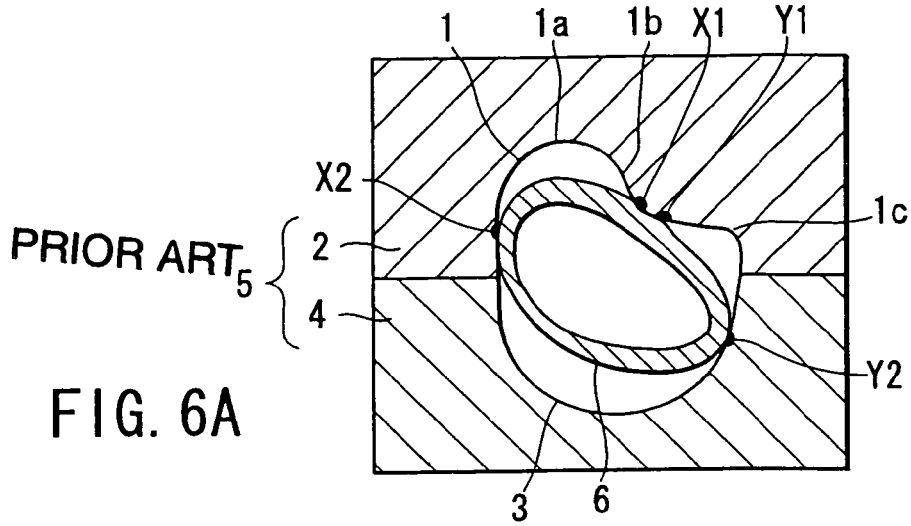
FIG. 6A is a sectional view illustrating a steel pipe and die assembly at the initial stage of the conventional hydroform process.
Figure 6B:
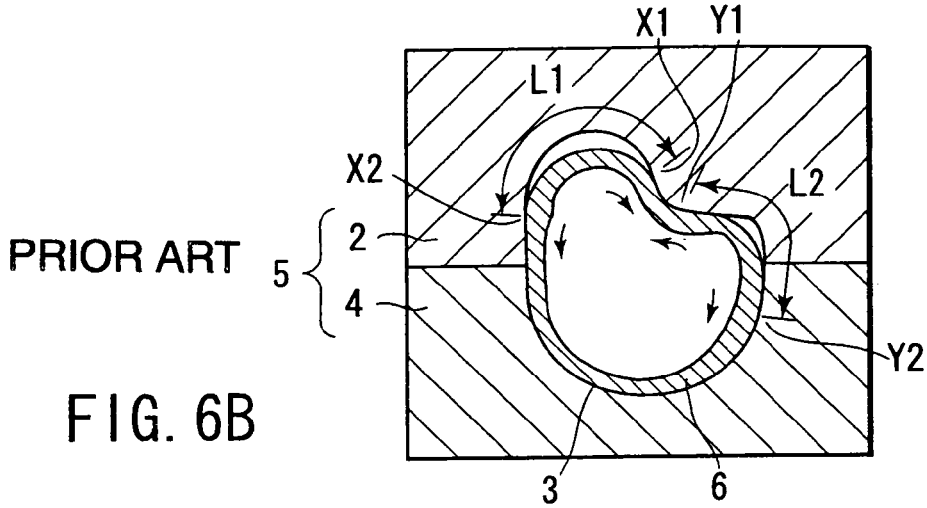
FIG. 6B is a sectional view illustrating the conventional steel pipe at a later forming stage.
Figure 6C:
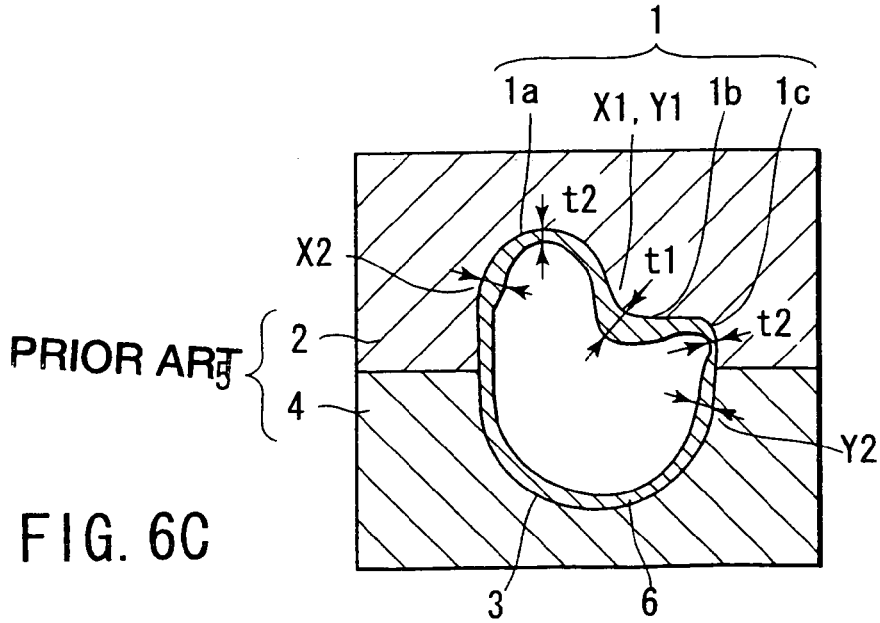
FIG. 6C is a sectional view illustrating the conventional steel pipe obtained when hydroforming is finished.

The die assembly 5 and steel pipe 6 shown in FIGS. 1A–4 are similar to the aforementioned ones shown in FIGS. 5 and 6. Therefore, concerning the die assembly 5 and steel pipe 6, like reference numerals denote like elements in these figures, and no description is given thereof.

A description will now be given of a hydroform process using the deformation assisting member 10.

Firstly, the deformation assisting member 10 is attached to the outer peripheral surface of the steel pipe 6. As shown in FIGS. 1B and 2A, the die assembly 5 for hydroforming the reinforcing member 7 has a molding surface 1 including an indent 1*a*, projection 1*b* and stepped portion 1*c*, etc. Corner portions X1 and Y1 and inner surfaces X2 and Y2 are the areas with which the deformation assisting member 10 is earliest brought into contact, when the steel pipe 6 is expanded. In other words, the corner portions X1 and Y1 and inner surfaces X2 and Y2 serve as elements for limiting the expansion of the steel pipe 6 during hydroforming.

The corner portions X1 and Y1 and inner surfaces X2 and Y2 are provided on substantially the entire molding surface 1 along the axis of the die assembly 5 (in the direction indicated by arrow Z in FIG. 1B). Further, the molding surface 1 has molding areas L1 and L2 continuous with the corner portions X1 and Y1 and inner surfaces X2 and Y2, as is shown in FIG. 3B. The molding areas L1 and L2 are also provided on substantially the entire molding surface 1 along the axis of the die assembly 5.

Figure 1A:
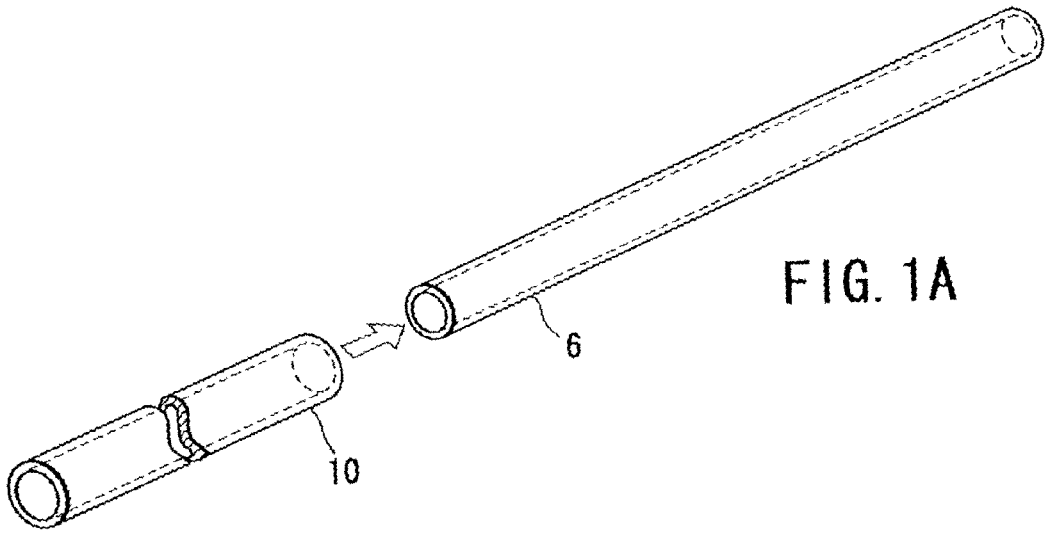
FIG. 1A is a perspective view illustrating a steel pipe and assistant member used in a hydroform process according to an embodiment of the invention.
Figure 1B:
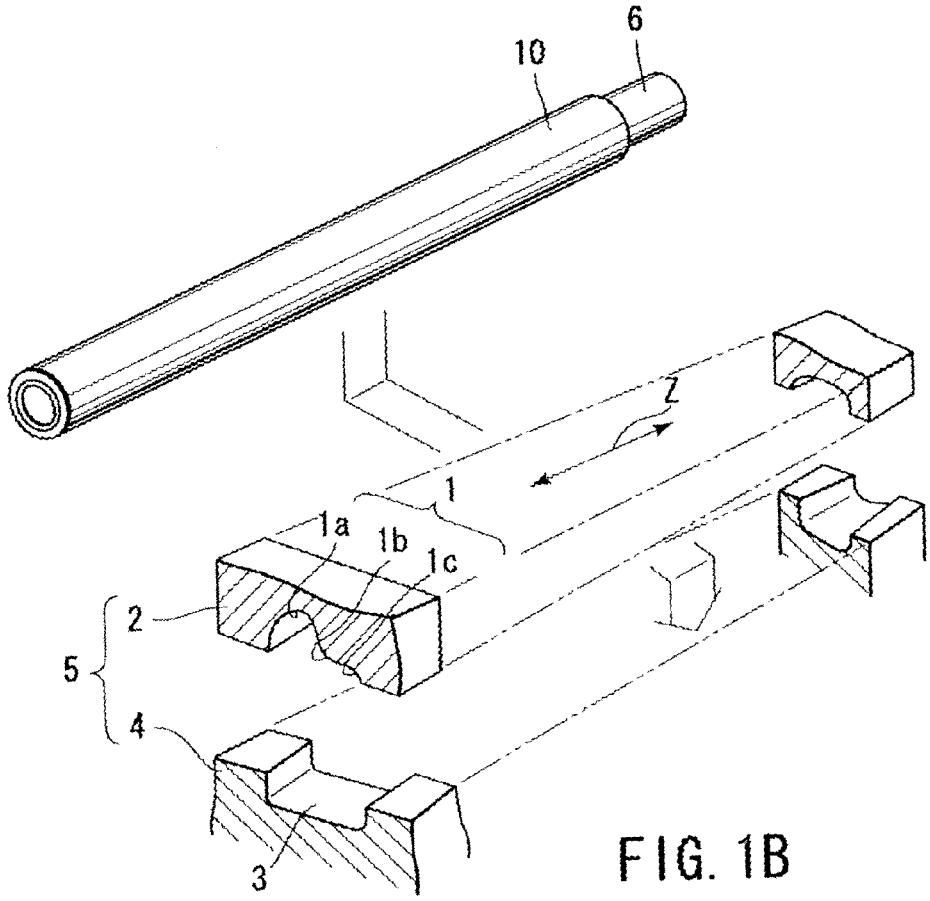
FIG. 1B is a perspective view illustrating the assistant member shown in FIG. 1A, and also illustrating a die assembly partly in section.

In the embodiment, as shown in FIG. 1A, the deformation assisting member 10 is, for example, a tubular member of a size that enables the member to be fitted on substantially the entire outer peripheral surface of the steel pipe 6. This tubular member (deformation assisting member 10) is softer than the steel pipe 6, and is made of a relatively soft metal, such as aluminum, a low carbon steel, copper, etc., which is an incompressible, plastically deformable material that shows a small volume change under a compression load.

Before the steel pipe 6 is inserted into the die assembly 5, the deformation assisting member 10 is fitted on substantially the entire outer peripheral surface of the steel pipe 6 as is shown in FIG. 1B. At this time, it does not matter if there is a slight clearance between the outer periphery of the steel pipe 6 and the inner periphery of the deformation assisting member 10. The deformation assisting member 10 covers at least the portions of the outer peripheral surface of the steel pipe 6, which correspond to the corner portions X1 and Y1, inner surfaces X2 and Y2 and molding areas L1 and L2.

After the deformation assisting member 10 is attached to the steel pipe 6, the steel pipe 6 and deformation assisting member 10 are placed in the die assembly 5, i.e., into the molding space defined by the molding surface 1 of an upper die 2 and the molding surface 3 of a lower die 4, as shown in FIGS. 1B and 2A.

Thereafter, pressurized water, as an example of a pressurized liquid, is supplied into the steel pipe 6, thereby expanding the pipe 6 by internal pressure. As a result of expansion, the outer peripheral surface of the steel pipe 6 starts to be brought into tight contact with an inner surface of the deformation assisting member 10.

When the steel pipe 6 starts to expand, the deformation assisting member 10 covering the steel pipe 6 also expands as shown in FIG. 3A. Accordingly, the outer peripheral surface of the deformation assisting member 10 starts to be brought into contact with the corner portions X1 and Y1 and inner surfaces X2 and Y2. As a result, the expansion of the steel pipe 6 is advanced with the deformation assisting member 10 kept in contact with the corner portions X1 and Y1 and inner surfaces X2 and Y2.

In the aforesaid conventional hydroform process, when the steel pipe 6 is expanded, a problem exists in that the wall thickness of the steel pipe 6 becomes thinner at the molding areas L1 and L2 than at the other portions. On the other hand, in the embodiment of the present invention, the deformation assisting member 10 provided on the outer periphery of the steel pipe 6 eliminates such a disadvantage. The reason for this will now be described.

The deformation assisting member 10 is made of a material softer than the steel pipe 6 and showing a small volume change under a compression load. When the deformation assisting member 10 is brought into contact with the corner portions X1 and Y1 and inner surfaces X2 and Y2, the portions of the member 10 corresponding to the corner portions X1 and Y1 and inner surfaces X2 and Y2 receive a compression load, as is shown in FIGS. 3B and 4. At this time, part of the material of the deformation assisting member 10 plastically flows to escape from the corner portions X1 and Y1. The arrows F1 in FIG. 4 indicate the flow directions of the material of the deformation assisting member 10.

When the deformation assisting member 10 plastically flows, the outer peripheral surface of the steel pipe 6 is in pressure contact with the inner peripheral surface of the deformation assisting member 10 by the inner pressure applied to the steel pipe 6. Accordingly, the peripheral wall of the steel pipe 6 that overlaps the portion of the deformation assisting member 10, at which plastic flow occurs, is dragged in the flow directions of the material of the deformation assisting member 10 by friction therebetween.

As a result, the peripheral wall of the steel pipe 6 is extended in the directions indicated by the arrows F2 in FIG. 4, along the flow directions F1 of the deformation assisting member 10. This being so, the deformation of the steel pipe 6 is not interrupted at the portions kept in contact with the die assembly 5, i.e., the steel pipe is smoothly expanded.

The deformation assisting member 10 is provided along the corner portions X1 and Y1 and inner surfaces X2 and Y2, with which the outer periphery of the steel pipe 6 is earliest brought into contact during hydroforming, and also along the molding areas L1 and L2 where the deformation is locally advanced. Therefore, when the deformation assisting member 10 plastically flows, expansion is advanced in the molding areas L1 and L2 to the same degree as the other portions, as is shown in FIG. 3C. In other words, hydroforming is executed without a local reduction in wall thickness.

As seen from FIG. 3C, the deformation assisting member 10 is finally pressed against the molding surfaces 1 and 3 of the die assembly 5 and is formed into a desired product shape together with the steel pipe 6. Thus, the reinforcing member 7 with the deformation assisting member 10 press-fitted on the pipe is obtained as shown in FIG. 2B. In the resultant reinforcing member 7, the portions of the deformation assisting member 10 that correspond to the molding areas L1 and L2 are thick as a result of plastic flow. Accordingly, the portions of the reinforcing member 7 that correspond to the molding areas L1 and L2 are thicker than the other portions.

If the hydroform product has a complicated sectional shape, if only an original tube member (e.g. a steel pipe) is used as in the prior art, the wall thickness of the original tube member is locally reduced as a result of local contact between the original tube member and die assembly 5 that occurs during forming.

On the other hand, in the embodiment, the wall thickness t3 (indicated in FIG. 3C) of the steel pipe 6 is substantially uniform over the entire circumference by virtue of hydroforming using the properties of the composite member that consists of the steel pipe 6 and deformation assisting member 10. This being so, disadvantages such as cracks, breakages, etc. of the steel pipe 6 can be avoided.

Moreover, in the embodiment, the deformation assisting member 10 formed of a tubular member is fitted on the outer peripheral surface of the steel pipe 6. Therefore, when the steel pipe 6 is expanded, the outer peripheral surface of the steel pipe 6 can be easily and tightly attached to the inner surface of the deformation assisting member 10. As a result, the deformation (expansion) of the steel pipe 6 due to the plastic flow of the deformation assisting member 10 can be smoothly advanced.

In addition, since the wall thickness t3 of the steel pipe 6 can be made uniform, even a hydroform product, such as a reinforcing member 7 of a complicated sectional shape, can be made to have a high rigidity by thinning the wall thickness while utilizing the features of the hydroform process.

The invention is not limited to the above-described embodiment, but may be modified in various ways without departing from its scope. For example, portions of the steel pipe may be individually covered with a plurality of deformation assisting members, instead of covering the greater part of the steel pipe with a single deformation assisting member as in the embodiment.

In the embodiment, the deformation assisting member formed of a tubular member is kept in tight contact with the outer peripheral surface of the steel pipe, thereby extending the peripheral wall of the steel pipe in accordance with the plastic flow of the deformation assisting member. However, the assisting member is not limited to the tubular deformation assisting member.

For example, an assisting member in the form of a sheet may be fixed to the outer peripheral surface of the steel pipe by fixing means such as welding or adhesion. Specifically, the assisting sheet member may be provided on the area ranging from the predetermined portions of the outer peripheral surface of the steel pipe, which are earliest brought into contact with the inner surface of the die assembly during expansion, to the molding areas in which local extension occurs.

The assisting member of the invention may be provided not only on the area ranging from the aforementioned predetermined portions of the original tube member to the molding areas, but also on the other outer peripheral surfaces. Although the embodiment describes a reinforcing member for use in the body of a vehicle, the invention is not limited to the forming of reinforcing members, but is also applicable to the forming of other vehicle members or members used for other purposes. The original tube member is not limited to steel pipes but may be other pipes.

The hydroform product of the invention can be used to form various components, in addition to a reinforcing member for reinforcing the body of a vehicle. Further, it can be used for various structures other than vehicles.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A hydroform process of advancing expansion of an original tube member, with a predetermined portion approaching an outer peripheral surface of the original tube member, by pressuring the original tube member from inside, using a die assembly having molding surfaces and the predetermined portion, the predetermined portion being included in the molding surfaces and approaching the outer peripheral surface of the original tube member during hydroforming, comprising:

attaching an assisting member, made of an incompressible material softer than the original tube member, at least to an area included in the outer peripheral surface of the original tube member and corresponding to the predetermined portion of the die assembly;

setting, into the die assembly, the original tube member with the assisting member attached thereto; and pressuring the original tube member from inside, thereby forming the original tube member into a shape corresponding to the molding surfaces, wherein the assisting member covers the outer peripheral surface of the original tube member for a distance greater than one half the peripheral surface in the axial direction of the original tube but less than the total outer peripheral surface of the original tube member before setting into the dye assembly.

2. The hydroform process according to claim 1, wherein the assisting member is a tubular member to be fitted on the outer peripheral surface of the original tube member, an inner surface of the assisting member being brought into tight contact with the outer peripheral surface of the original tube member as the tube member expands.

3. The hydroform process according to claim 2, wherein the original tube member is a steel pipe, and the assisting member is made of a low carbon steel.

4. The hydroform process according to claim 2, wherein the original tube member is a steel tube, and the assisting member is made of aluminum.

5. The hydroform process according to claim 1, wherein the original tube member is a steel pipe, and the assisting member is made of a low carbon steel.

6. The hydroform process according to claim 1, wherein the original tube member is a steel tube, and the assisting member is made of aluminum.

7. The hydroform process of claim 1, wherein both the assisting member and the original tube members are straight tubes before they are set into the dye assembly.

8. The hydroform process according to claim 1, wherein the assisting member is selected from the group consisting of low carbon steel, soft iron, copper, aluminum or aluminum alloy.

9. The hydroform process according to claim 1, wherein the assisting member is copper.

10. The hydroform process according to claim 1, wherein the tube is a steel pipe and the assisting member is copper.

11. A tube member for being formed by a hydroform process:

obtained by forming an original tube member into a shape corresponding to molding surfaces by pressuring the original tube member from inside, using a die assembly that has the molding surfaces and a predetermined portion included in the molding surfaces and projects toward an outer peripheral surface of the original tube member, wherein an assisting member, made of an incompressible material softer than the original tube member, the assisting member is on contact at least with an area included on an outer peripheral surface of an original tube member and the assisting member has a length greater than one half the outer peripheral surface in the axial direction of the original tube member but less than the total outer peripheral surface of the original tube member before setting into a dye assembly.

* * * * *